US006907960B2

(12) United States Patent
Klingler

(10) Patent No.: US 6,907,960 B2
(45) Date of Patent: Jun. 21, 2005

(54) SAFE AUTO-LOCKING BELAY OVERRIDE MECHANISM

(76) Inventor: Gregory Lee Klingler, 824 E. Iowa Ave., Denver, CO (US) 80210

( * ) Notice: Subject to any disclaimer, the term of this patent is extended or adjusted under 35 U.S.C. 154(b) by 0 days.

(21) Appl. No.: 10/748,858

(22) Filed: Dec. 29, 2003

(65) Prior Publication Data

US 2005/0061588 A1 Mar. 24, 2005

Related U.S. Application Data

(60) Provisional application No. 60/504,277, filed on Sep. 18, 2003.

(51) Int. Cl.[7] ..... B65H 59/16

(52) U.S. Cl. ..... 188/65.1; 182/5; 182/192

(58) Field of Search ..... 188/65.1–65.5; 182/5, 192, 193; 24/134 P, 134 KB, 134 R, 599.1, 599.6, 601.5

(56) References Cited

U.S. PATENT DOCUMENTS

| | | | | |
|---|---|---|---|---|
| 5,054,577 | A | 10/1991 | Petzl et al. | 182/5 |
| 5,076,400 | A | 12/1991 | Petzl et al. | 188/65.5 |
| 5,360,083 | A | 11/1994 | Hede | 182/5 |
| 5,577,576 | A | 11/1996 | Petzl et al. | 188/65.4 |
| 5,597,052 | A | 1/1997 | Rogleja | 188/65.5 |
| 5,850,893 | A | 12/1998 | Hede et al. | 182/193 |
| 6,029,777 | A | 2/2000 | Rogelja | 182/193 |
| 6,378,650 | B2 * | 4/2002 | Mauthner | 182/5 |
| 6,561,313 | B2 * | 5/2003 | Hewlett et al. | 182/5 |
| 2004/0020727 | A1 * | 2/2004 | Petzl et al. | 188/65.1 |

* cited by examiner

*Primary Examiner*—Douglas C. Butler

(57) ABSTRACT

A Safe Auto-Locking Belay Override Mechanism (24) is provided which causes an auto-locking belay device to lock a rope against movement if a belayer panics, as sometimes happens if a climber falls, after the belayer has overridden the normal function of the auto-locking belay device. The mechanism of the subject invention makes use of the realization that a belayer tends to grip an auto-locking belay device tightly when the belayer panics. The subject invention contains a pressure sensitive activation mechanism that acts on an override mechanism such that the normal function of the belay device will be overridden by only one of three different force levels. At either relatively low or relatively high levels of force exerted by the belayer on the pressure sensitive activation mechanism, the auto-locking belay device will function normally and lock a rope against further movement in the event that the rope exerts sufficient force on the auto-locking belay device such as when a climber falls. If, however, the belayer exerts an intermediate level of force on the pressure sensitive activation mechanism, the normal function of the auto-locking belay device will be overridden such that rope can be fed rapidly though the device.

4 Claims, 2 Drawing Sheets

SAFE AUTO-LOCKING BELAY OVERRIDE MECHANISM

CROSS-REFERENCE TO RELATED APPLICATIONS

Figure 1A:
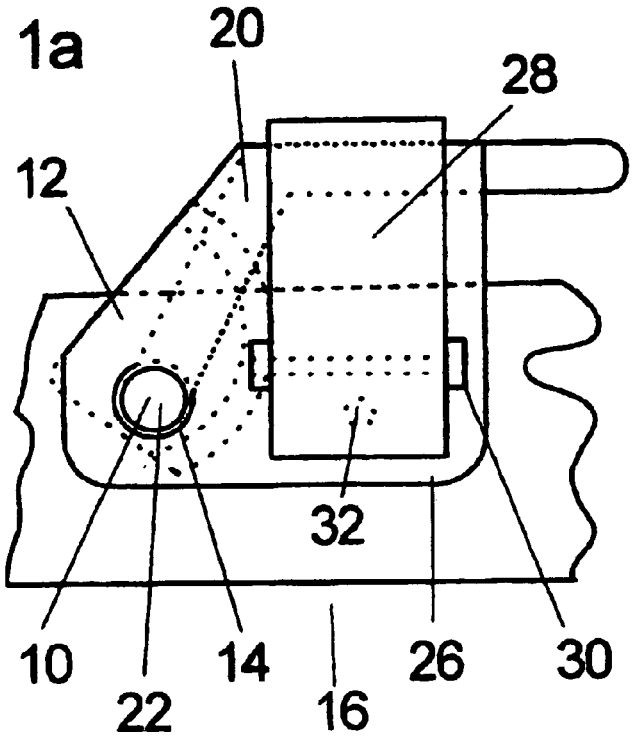

Provisional application No. 60/504,277 filed on Sep. 18, 2003.

STATEMENT REGARDING FEDERALLY SPONSORED RESEARCH AND DEVELOPMENT

Not applicable.

BACKGROUND

1. Field of Invention

This invention pertains to an auto-locking belay safety mechanism which improves the safety characteristics of an auto-locking belay device. In particular, it pertains to a mechanism that will cause a rope to be locked against passage through an auto-locking belay device even if the belayer panics after having overridden the locking mechanism within the auto-locking belay device.

2. Description of Prior Art

In the sport of rock climbing, a belay device is used to protect a climber. The person operating the belay device is known as the belayer. A climbing rope, one end of which is attached to the climber, runs through the belay device which is anchored near, or attached directly to the harness of, the belayer. The belayer can control the rate of movement of rope through the belay device and, if the climber falls, the belayer can stop the rope using the belay device, thereby stopping the fall of the climber.

There is a class of belay devices known as auto-locking belay devices. Such devices need no action on the part of the belayer to stop the rope in the event of a fall by the climber. If a climber falls, the forces of the rope on an auto-locking belay device cause the belay device to lock the rope. Unfortunately, these devices also tend to lock the rope when a belayer attempts to quickly feed rope out to the climber. This is because the act of feeding rope rapidly through the device yields approximately the same rope forces on the belay device as those experienced when a climber falls. The belayer, therefore, often has to temporarily override the normal function of an auto-locking belay device in order to rapidly feed rope through the device to the climber. Auto-locking belay devices therefore contain a means to override the normal function of the device. If a climber falls when the belayer has overridden the normal function of an auto-locking belay device, the belayer should release his hold on the device, thereby canceling the override function and allowing the belay device to function normally so as to lock the rope and stop the fall of the climber. Occasionally, a belayer will panic and actually grab the auto-locking belay device tighter, rather than releasing the device, when a climber falls while the belayer has overridden the normal function of the auto-locking belay device. In this situation, the instinct of the belayer is to grab harder, as if that would stop the rope, when in fact that action does not allow the override function to be cancelled and therefore allows the rope to continue to pass through the belay device. The result can be harmful or fatal to the climber since the fall is not stopped.

The subject Safe Auto-Locking Belay Override Mechanism solves a very dangerous problem of auto-locking belay devices by canceling the override function even if a belayer panics, as described above, during the fall of a climber. A novel and unobvious aspect of the invention relies on the fact that the belayer actually grabs the device tighter when he panics. The subject invention therefore consists of an override mechanism that responds differently to different force levels from the belayer, and to three force levels in particular. If there is minimal or no force exerted on the Safe Auto-Locking Belay Override Mechanism by the belayer, the auto-locking belay device's normal function will not be overridden and the auto-locking belay device can therefore lock the rope if the rope forces are sufficient to lock it, such as during a fall of a climber. If there is an intermediate amount of force exerted on the Safe Auto-Locking Belay Override Mechanism by the belayer, such as during the times when a belayer needs to feed rope through the belay device, the normal function of the auto-locking belay device will be overridden and therefore the rope will not be locked against movement through the auto-locking belay device. If, however, there is a high amount of force exerted on the Safe Auto-Locking Belay Override Mechanism by the belayer, such as when the belayer panics, the override function will be cancelled thereby allowing the auto-locking belay device to function normally and to lock the rope if the rope forces are sufficient such as during a fall of a climber.

Although there are many different styles of auto-locking belay devices, they all function by locking the rope against further movement if the rope exerts sufficient force on the device such as would occur when a climber falls, and they all have a means to override this normal function such that rope can be fed quickly through the device by the belayer when it is advantageous to do so. Much of the relevant prior art deals with descenders, devices which function like auto-locking belay devices but with the primary purpose of allowing a person to descend a rope. Examples of the prior art include U.S. Pat. No. 5,054,577 to Petzl et. al., U.S. Pat. No. 5,076,400 to Petzl et. al., U.S. Pat. No. 5,360,083 to Hede, U.S. Pat. No. 5,577,576 to Petzl et. al., U.S. Pat. No. 5,597,052 to Rogleja, U.S. Pat. No. 5,850,893 to Hede, and U.S. Pat. No. 6,029,777 to Rogleja. A very popular commercially available auto-locking belay apparatus is the GRIGRI made by the Petzl company of Crolles, France. None of the aforementioned examples of the prior art disclose, teach, or illustrate the unique function and use of the subject invention.

The potential safety problem with the override mechanism of auto-locking belay devices of the prior art is well known by those experienced in the art. Prior to the subject invention, attempts to mitigate this problem have focused on the physical interaction between the rope and the belay device, rather than on the realization that the belayer actually exerts greater force on the override mechanism when he panics while the override mechanism is activated. For example, the GriGri contains a locking cam that is biased against movement by a spring. The purpose of the locking cam is to lock the rope if sufficient rope forces are present to rotate the cam. The purpose of the spring, that biases the cam against movement, is to allow the belayer to feed rope through the device without having to override the normal function of the device. Although this works during cases when the belayer can feed the rope slowly and steadily through the device, it does not work in the case that the belayer needs to feed rope quickly through the device. If a belayer needs to feed rope quickly through the GriGri, he must still override the normal function of the GriGri in order to do so.

The concept of the subject Safe Auto-Locking Belay Override Mechanism, which responds differently to three different belayer force levels, can be applied to render any of these prior art auto-locking belay devices much safer; but the particular embodiment of the invention will be different depending on the design of the auto-locking belay device for which it is intended. The particular embodiments of the Safe Auto-Locking Belay Override Mechanism described and illustrated herein are for an auto-locking belay device which operates based on a rotating locking cam, such as the device illustrated in U.S. Pat. No. 5,076,400 to Petzl et al. The subject invention is intended, however, to cover all embodiments which utilize the novel concepts described above, not just the particular embodiments illustrated.

SUMMARY

The essence of the present invention is a safer mechanism to override the normal function of an auto-locking belay device. The mechanism makes use of the fact that a belayer actually exerts greater force on the override mechanism of an auto-locking belay device if the belayer panics, such as sometimes occurs during the fall of a climber.

OBJECTS AND ADVANTAGES

In view of the foregoing, it is a primary object of the present invention to provide a safety auto-locking belay device that will lock a rope against movement if a belayer panics after having overridden the normal function of the auto-locking belay device.

Another object is that Safe Auto-Locking Belay Override Mechanism of the subject invention does not add significantly to the size or weight of an auto-locking belay device.

Still another object is that the Safe Auto-Locking Belay Mechanism is simple to use.

These and other objects of the subject invention will become apparent to those familiar with the different types of auto-locking belay devices when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

DRAWING FIGURES

FIG. 1*a* presents a front view of a first embodiment of the subject invention including certain other components of an auto-locking belay device to which the subject invention is attached.

Figure 1B:
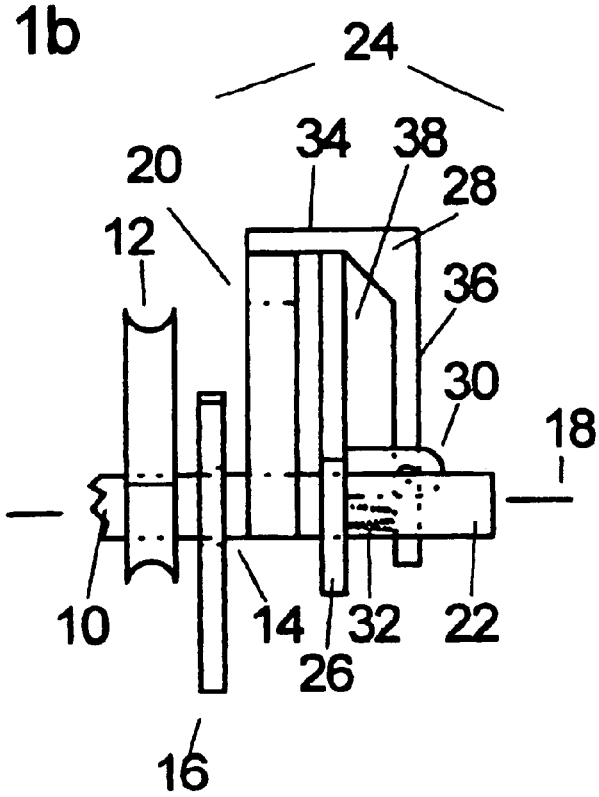

FIG. 1*b* presents a side view of a first embodiment of the subject invention including certain other components of an auto-locking belay device to which the subject invention is attached.

Figure 2:
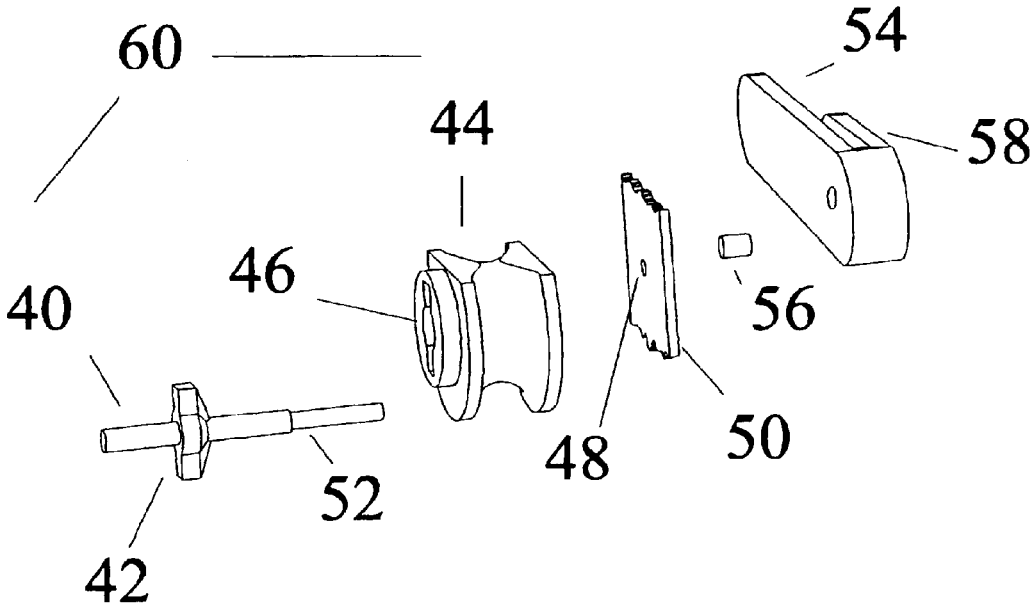

FIG. 2 presents an exploded view of the component of a Second Embodiment Safe Auto-Locking Belay Override Mechanism (60).

Figure 3:
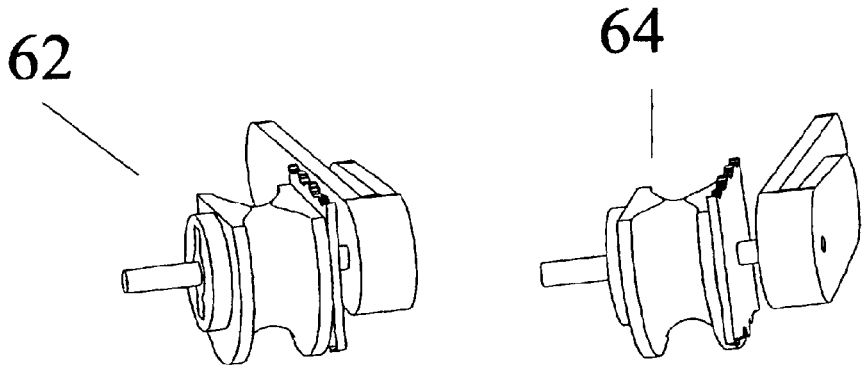

FIG. 3 illustrates left front (62) and right front (64) views of the Second Embodiment Auto-Locking Belay Override Mechanism (60).

REFERENCE NUMERALS IN DRAWINGS

10 Axle
12 Rotating Locking Cam
14 Axle Passage Opening
16 Face Plate
18 Axis Of Rotation
20 Extension Arm
22 Axle Extension
24 Safe Auto-Locking Belay Override Mechanism
26 Force Isolation Plate
28 Lever
30 Hinge
32 Spring
34 Lever Top Leg
36 Lever Side Leg
38 Outside Surface
40 Second Embodiment Axle
42 Axle Key
44 Second Embodiment Locking Cam
46 Cam Key Slot
48 Opening
50 Wall
52 Axle Stop
54 Arm
56 Spring
58 Pressure Plate
60 Second Embodiment Auto-Locking Belay Override Mechanism
62 Left Front
64 Right Front

DESCRIPTION AND OPERATION—FIRST EMBODIMENT

FIG. 1*a* and FIG. 1*b*—In an auto-locking belay device (not entirely shown), an Axle (10) extends outward from a Rotating Locking Cam (12), through an Axle Passage Opening (14) in a Face Plate (16) of the auto-locking belay device (not entirely shown). The Axle (10) is fixedly attached to the Rotating Locking Cam (12) and forms the Axis Of Rotation (18) around which the Rotating Locking Cam (12) can rotate. An Extension Arm (20) is fixedly attached to the Axle (10) at a point on the opposite side of the Face Plate (16) relative to the Rotating Locking Cam (12). An Axle Extension (22) is fixedly attached to an end of the Axle (10) at the Extension Arm (20). A Safe Auto-Locking Belay Override Mechanism (24) comprises the Axle Extension (22), a Force Isolation Plate (26), a Lever (28), a Hinge (30), and a Spring (32). The Force Isolation Plate (26) is pivotally attached to the Axle Extension (22). The Force Isolation Plate (26) can rotate around the Axle Extension (22) even if the Axle (10) is not rotating. The Lever (28) is attached to the Force Isolation Plate (26) by way of the Hinge (30). The Lever (28) has an "L" shape and is force loaded by the Spring (32) such that in its normal position, a Lever Top Leg (34) is positioned directly above the Extension Arm (20) and a Lever Side Leg (36) is positioned near and parallel to an Outside Surface (38) of the Force Isolation Plate (26). The Spring (32) is tensioned such that a mild force exerted on the Lever Side Leg (36) at a point below the Hinge (30) in the direction of the Force Isolation Plate (26) will not result in significant movement of the Lever (28), but a relatively heavy force exerted on the Lever Side Leg (36) at a point below the Hinge (30) will cause the Lever (28) to rotate on the Hinge (30), thereby causing the Lever Top Leg (34) to move to a position which is not directly above the Extension Arm (20).

The Rotating Locking Cam (12) is the mechanism within the auto-locking belay device (not entirely shown) that rotates to lock the rope (not shown). Since the Extension Arm (20) is fixedly attached to the Axle (10) which, in turn, is fixedly attached to the Rotating Locking Cam (12), rotation of the Rotating Locking Cam (12) causes the Extension Arm (20) to rotate with along with the Axle (10).

Consequently, blocking the movement of the Extension Arm (20) will prevent the Rotating Locking Cam (12) from rotating, thereby overriding the normal function of the auto-locking belay device and preventing the locking of the rope (not shown).

In operation, a belayer should only hold the auto-locking belay device (not entirely shown) when he needs to feed out rope to a climber. When a belayer does need to feed out rope, he must grab the auto locking belay device (not entirely shown) such that his fingers exert mild pressure on the Lever Side Leg (36) at a point below the Hinge (30) and the auto-locking belay device (not entirely shown) rests in his palm positioned such that no part of his hand blocks the rotation path of the Extension Arm (20).

If a climber falls when the belayer is not feeding rope and therefore is not holding the auto-locking belay device (not entirely shown), the Rotating Locking Cam (12) will rotate to lock the rope (not shown). This will cause the Extension Arm (20) to rotate, which will exert force on the Lever Top Leg (34) thereby causing the Force Isolation Plate (26) to also rotate.

If a belayer grabs the auto-locking belay device (not entirely shown) properly, as discussed above, in order to feed rope, the mild pressure exerted on the Lever Side Leg (36) by his fingers will be sufficient to prevent the Force Isolation Plate (26) from rotating, but will not be sufficient to compress the Spring (32). Therefore the Lever Top Leg (34) will remain positioned above the Extension Arm (20) preventing movement of the Extension Arm (20) thus preventing rotation of the Rotating Locking Cam (12) thereby overriding the normal function of the auto-locking belay device and preventing locking of the rope. In this manner, the belayer can rapidly feed rope (not shown) through the auto-locking belay device (not entirely shown).

If a climber falls when the belayer has grabbed the auto-locking belay device (not entirely shown) in order to feed out rope, the belayer can simply let go of the auto locking belay device (not entirely shown) and it will lock the rope (not shown) as described previously. If, however, the belayer panics when the climber falls and tightens his grasp on the Safe Auto-Locking Belay Override Mechanism (24), the Safe Auto-Locking Belay Override Mechanism (24) will function in a manner that does not override the normal function of the auto-locking belay device, thus allowing the Rotating Locking Cam (12) to lock the rope. Specifically, the panic reaction of the belayer will cause him to grasp the Safe Auto-Locking Belay Override Mechanism (24) more firmly. This firmer grasp by the belayer will cause the Lever Side Leg (36) to compress the Spring (32) causing the Lever (28) to rotate around the Hinge (30), thereby causing the Lever Top Leg (34) to move out of its position above the Extension Arm (20). With the Extension Arm (20) no longer blocked by the Lever Top Leg (34), the Extension Arm (20), Axle (10) and Rotating Cam (12) will all rotate thus locking the rope (not shown).

DESCRIPTION AND OPERATION—SECOND EMBODIMENT

FIG. 2—A Second Embodiment Axle (40) contains an Axle Key (42). A Second Embodiment Locking Cam (44) contains a Cam Key Slot (46) shaped such that the Axle Key (42) fits smoothly within the Cam Key Slot (46). The Second Embodiment Locking Cam (44) is positioned on the Second Embodiment Axle (40). When the Axle Key (42) is engaged in the Cam Key Slot (46), both the Second Embodiment Axle (40) and the Second Embodiment Locking Cam (44) move (rotate) together. When the Axle Key (42) is not engaged in the Cam Key Slot (46), the Second Embodiment Locking Cam (44) can rotate around the Second Embodiment Axle (40) independent from any rotation of the Second Embodiment Axle (40). A portion of the Second Embodiment Axle (40) passes through an Opening (48) in a Wall (50) of the auto-locking belay device (not entirely shown). The Second Embodiment Axle (40) contains an Axle Stop (52) that serves to prevent further passage of the Second Embodiment Axle (40) through the Opening (48) in the Wall (50). An end of the Second Embodiment Axle (40) is firmly attached to an Arm (54) such that the Arm (54) rotates up or down whenever the Second Embodiment Axle (40) rotates. A portion of the Second Embodiment Axle (40) passes through a Spring (56). The Spring (56) is positioned between the Wall (50) and the Arm (54). In normal configuration, the Spring (56) is compressed slightly such that it pushes outward on the Arm (54) thus acting to hold the Axle Key (42) in the Cam Key Slot (46). The Second Embodiment Axle (40) and the Second Embodiment Locking Cam (44) are dimensioned such that the Axle Key (42) is fully engaged in the Cam Key Slot (46) when the Axle Stop (52) is contacting the Wall (50). The outer portion of the Arm (54) contains a Pressure Plate (58). Although certain components, such as the Second Embodiment Locking Cam (44), perform multiple roles within the auto-locking belay device (not entirely shown), all numbered components mentioned previously comprise the Second Embodiment Auto-Locking Belay Override Mechanism (60).

FIG. 3—Presents Left Front (62) and Right Front (64) views of the components comprising the Second Embodiment Auto-Locking Belay Override Mechanism (60).

In normal operation, the Axle Key (42) is engaged in the Cam Key Slot (46). If a climber falls and the belayer is not blocking the Arm (54), the Second Embodiment Locking Cam (44) will rotate, along with the Arm (54), and the auto-locking belay device (not entirely shown) will function normally thus locking the rope against further movement. By exerting intermediate inward pressure on the Pressure Plate (58), the belayer can feed out rope quickly. The intermediate inward pressure on the Pressure Plate (58) keeps the Arm (54) from rotating and thus keeps the Second Embodiment Locking Cam (44) from rotating thus overriding the normal function of the auto-locking belay device (not entirely shown). If the belayer exerts significant inward pressure on the Pressure Plate (58), such as in a case when the belayer panics, the Arm (54) will move inward and the Spring (56) will further compress, thus causing the Axle Key (42) to disengage from the Cam Key Slot (46). The Second Embodiment Locking Cam (44) will then rotate independently from the Second Embodiment Axle (40) and the auto-locking belay device (not entirely shown) will lock. After such an event, the Arm (54) can simply be rotated upward to reengage the Axle Key (42) in the Cam Key Slot (46), in order to then lower the climber.

CONCLUSION, RAMIFICATIONS, AND SCOPE

Thus the reader will see that the Safe Auto-Belay Override Mechanism of the subject invention yields a far safer auto-locking belay device relative to the prior art.

While the above descriptions contain many specificities, these should not be construed as limitations on the scope of the invention, but rather as exemplification of two embodiments thereof. The novelty of the present invention lies not within any particular mechanical embodiment, but within the recognition that a belayer tends to grip a belay device tighter when he panics and this tighter grip can be utilized in a way that enhances the safety of an auto-locking belay device. Accordingly, the scope of the invention should be determined not by the particular embodiments illustrated, but by the appended claims and their legal equivalents.

What is claimed is:

1. A safe auto-locking belay override mechanism for the sport of rock climbing; said safe auto-locking belay override mechanism for use with an auto-locking belay device containing a locking surface which rotates on an axle to pinch a rope against a fixed surface, thereby preventing further movement of said rope, in an event in which sufficient force is exerted on said auto-locking belay device by said rope such as in the event of a fall by a climber; said safe auto-locking belay override mechanism comprising an arm attached to said locking surface either directly or by way of said axle, said arm thus rotating with said locking surface as said locking surface rotates; said safe auto-locking belay override mechanism further comprising a pressure sensitive arm inhibition means; said pressure sensitive arm inhibition means inhibiting movement of said arm only when a relatively intermediate level of pressure is exerted on said pressure sensitive arm inhibition means; said pressure sensitive arm inhibition means being unable to inhibit movement of said arm when either a relatively high or relatively low level of pressure is exerted on said pressure sensitive arm inhibition means; relatively intermediate pressure exerted on said pressure sensitive arm inhibition means being sufficient to inhibit movement of said arm, thus restraining movement of said locking surface, thus overriding the rope locking function of said auto-locking belay device; relatively high or relatively low pressure exerted on said pressure sensitive arm inhibition means having no inhibiting effect on the movement of said arm, thus allowing said locking surface to rotate on said axle to pinch said rope in said event in which sufficient force is exerted on said auto-locking belay device by said rope; said safe auto-locking belay override mechanism thus providing safety by allowing said locking surface to lock said rope in the otherwise potentially dangerous situation in which a belayer panics, thus gripping said pressure sensitive arm inhibition means with greater force, when a climber falls after said belayer has blocked rotation of said locking surface by gripping said pressure sensitive arm inhibition means with intermediate force.

2. The mechanism of claim 1 wherein said pressure sensitive arm inhibition means comprises a force isolation plate pivotally mounted on said axle at a point on the opposite side of said arm relative to said locking surface; said force isolation plate being able to rotate around said axle independent from any rotation of said axle; a hinge mounted on said force isolation plate supporting a lever; said lever being pivotally mounted on said hinge; said hinge acting as a fulcrum for said lever; a lower portion of said lever, below said hinge, being biased by a spring such that in a resting mode an upper portion of said lever, above said hinge, extends over said arm and through the path of rotation of said arm; said safe auto-locking belay override mechanism responding differently to each of three pressure levels exerted on said lower portion of said lever as follows:

a) low or no pressure causing said lever to slip free from a belayer's hands in said event in which sufficient force is exerted on said auto-locking belay device by said rope so as to cause said locking surface to begin to rotate along with said axle; rotation of said axle causing said arm to rotate, rotation of said arm causing said arm to contact said upper portion of said lever thereby causing rotation of said lever along with said force isolation plate, rotation of said lever causing said lever to slip free from said belayer's hands thus allowing said locking surface to continue to rotate and lock said rope;

b) intermediate pressure being insufficient to further compress said spring but being sufficient to prevent said lever from slipping free from said belayer's hands in said event in which sufficient force is exerted on said auto-locking belay device by said rope so as to cause said locking surface to begin to rotate along with said axle; rotation of said axle causing said arm to rotate until said arm contacts said upper portion of said lever; said lever blocking further rotation of said arm, thereby blocking further rotation of said axle, thereby blocking further rotation of said locking surface;

c) high pressure being sufficient to further compress said spring thus causing said lever to rotate with respect to said hinge, thus causing said upper portion of said lever to move out of said path of rotation of said arm, thus allowing said arm to rotate unimpeded, thus allowing said axle to rotate unimpeded in said event in which sufficient force is exerted on said auto-locking belay device by said rope so as to cause said locking surface to begin to rotate along with said axle, thus allowing said locking surface to continue to rotate and lock said rope.

3. A safe auto-locking belay override mechanism for the sport of rock climbing; said safe auto-locking belay override mechanism for use with an auto-locking belay device containing a locking surface which rotates on an axle to pinch a rope against a fixed surface, thereby preventing further movement of said rope, in an event in which sufficient force is exerted on said auto-locking belay device by said rope such as in the event of a fall by a climber; said safe auto-locking belay override mechanism comprising an arm normally attached to said locking surface either directly or by way of said axle, said arm thus normally rotating with said locking surface as said locking surface rotates; said safe auto-locking belay override mechanism further comprising a pressure sensitive arm engagement means; said pressure sensitive arm engagement means causing said arm to be engaged with said locking surface only when a pressure exerted on said arm is below a specific threshold level; said pressure sensitive arm engagement means causing said arm to be disengaged from said locking surface when a pressure above said threshold level is exerted on said arm; relatively low pressure, below said threshold level, exerted on said arm allowing said auto-locking belay device to slip from a belayer's hands in an event in which sufficient rope forces are exerted on said auto-locking belay device, such as during the fall of a climber, thus allowing said arm to rotate along with said locking surface, thus locking said rope; relatively intermediate pressure, below said threshold level, exerted on said arm being sufficient to restrain movement of said arm, thus restraining movement of said locking surface, thus overriding the rope locking function of said auto-locking belay device; relatively high pressure, above said threshold level, exerted on said arm causing said arm to be disengaged from said locking surface, thus having no influence on the movement of said locking surface, thus allowing said locking surface to rotate on said axle to pinch said rope in said event in which sufficient force is exerted on said auto-locking belay device by said rope.

4. The mechanism of claim 3 wherein said locking surface comprises a portion of a surface of a cam and said pressure sensitive arm engagement means comprises a key affixed to said axle, a key slot within a side of said cam, a spring, and said arm attached to said axle; said key able to fit within said key slot; said pressure sensitive arm engagement means being engaged when said key is within said key slot thus causing said axle to rotate with said cam whenever said cam rotates, thus causing said arm to rotate when said locking surface rotates; said pressure sensitive arm engagement means being disengaged when said key is not within said key slot thus allowing said cam to rotate around said axle independent from any rotation of said axle, thus allowing said locking surface to rotate independent from any movement of said arm; said spring positioned and partially compressed between a surface of said auto-locking belay device and said arm; a force exerted by said spring thus causing said pressure sensitive arm engagement means to be engaged when no external pressure is exerted on said arm; said pressure sensitive arm engagement means responding differently to each of three pressure levels exerted on said arm as follows:

a) low or no pressure allowing said pressure sensitive arm engagement means to remain engaged, thus ensuring that said cam and said axle rotate together, thus ensuring that rotation of said cam causes said arm to rotate; said low or no pressure being insufficient to restrain said arm in said event in which sufficient force is exerted on said auto-locking belay device by said rope so as to cause said locking surface to begin to rotate along with said axle; said arm thus slipping free from said belayer's hands, said cam with said locking surface thus continuing to rotate and lock said rope;

b) intermediate pressure being insufficient to further compress said spring but being sufficient to prevent rotation of said arm in an event in which sufficient force would be exerted on said auto-locking belay device by said rope so as to cause said cam with said locking surface to rotate along with said axle were said cam with said locking surface not restrained from doing so by said intermediate pressure on said arm; said pressure sensitive arm engagement means remaining engaged being that said intermediate pressure is not sufficient to further compress said spring;

c) high pressure being sufficient to further compress said spring thus causing said pressure sensitive arm engagement means to become disengaged, thus allowing said cam to rotate independent from said axle thus allowing said cam with said locking surface to continue to rotate and lock said rope in said event in which sufficient force is exerted on said auto-locking belay device by said rope so as to cause said locking surface to begin to rotate along with said axle.

* * * * *